US010271699B2

(12) United States Patent
Li et al.

(10) Patent No.: US 10,271,699 B2
(45) Date of Patent: Apr. 30, 2019

(54) AUTONOMOUS CLEANING DEVICE AND WIND PATH STRUCTURE OF SAME

(71) Applicants: Beijing Xiaomi Mobile Software Co., Ltd., Beijing (CN); Beijing Rockrobo Technology Co. Ltd., Beijing (CN)

(72) Inventors: Xing Li, Beijing (CN); Xiaoyu Liu, Beijing (CN); Yongfeng Xia, Beijing (CN)

(73) Assignees: Beijing Xiaomi Mobile Software Co., Ltd., Beijing (CN); Beijing Rockrobo Technology Co., Ltd, Beijing (CN)

( * ) Notice: Subject to any disclaimer, the term of this patent is extended or adjusted under 35 U.S.C. 154(b) by 77 days.

(21) Appl. No.: 15/486,477

(22) Filed: Apr. 13, 2017

(65) Prior Publication Data

US 2017/0296010 A1 Oct. 19, 2017

(30) Foreign Application Priority Data

Apr. 14, 2016 (CN) ..... 2016 1 0232735

(51) Int. Cl.
*A47L 9/04* (2006.01)
*A47L 9/28* (2006.01)
(Continued)

(52) U.S. Cl.
CPC ..... *A47L 9/0411* (2013.01); *A47L 5/22* (2013.01); *A47L 5/30* (2013.01); *A47L 9/0477* (2013.01);
(Continued)

(58) Field of Classification Search
CPC . A47L 9/0411; A47L 5/22; A47L 5/30; A47L 9/0477; A47L 9/0488; A47L 9/122;
(Continued)

(56) References Cited

U.S. PATENT DOCUMENTS 7,120,965 B2 10/2006 Hisano et al.
9,078,552 B2 7/2015 Han et al.
(Continued)

FOREIGN PATENT DOCUMENTS

CN 1642465 A 7/2005
CN 2780370 Y 5/2006
(Continued)

OTHER PUBLICATIONS

Extended European Search Report issued in Application No. 17164318.2, mailed from the European Patent Office, dated Feb. 13, 2018.
(Continued)

*Primary Examiner* — Dung Van Nguyen
(74) *Attorney, Agent, or Firm* — Finnegan, Henderson, Farabow, Garrett & Dunner LLP

(57) ABSTRACT

The present disclosure relates to an autonomous cleaning device and a wind path structure for use in the autonomous cleaning device. The wind path structure includes: a cleaning component for cleaning cleaned objects, a cleaned object storage container for storing the cleaned objects, and a power component for generating a wind, the cleaning component, the cleaned object storage container, and the power component being arranged sequentially in a moving direction of the autonomous cleaning device; a first-level wind duct located between the cleaning component and the cleaned object storage container, wherein the first-level wind duct is coupled with the power component such that the cleaned objects are delivered to the cleaned object storage container by the wind generated by the power component; and a second-level wind duct located between the cleaned object storage container and the power component, wherein the second-level wind duct has a bell-mouth shape and includes an inner wall, the inner wall including an arc-shaped segment facing toward the wind coming from the
(Continued)

cleaned object storage container to direct the wind to an air inlet of the power component.

20 Claims, 17 Drawing Sheets

(51) Int. Cl.

| | |
|---|---|
| ***A47L 9/14*** | (2006.01) |
| ***A47L 9/12*** | (2006.01) |
| ***A47L 5/22*** | (2006.01) |
| ***A47L 5/30*** | (2006.01) |
| ***A47L 9/16*** | (2006.01) |

(52) U.S. Cl.
CPC ..... *A47L 9/0488* (2013.01); *A47L 9/122* (2013.01); *A47L 9/1409* (2013.01); *A47L 9/149* (2013.01); *A47L 9/1683* (2013.01); *A47L 9/2826* (2013.01); *A47L 9/2831* (2013.01); *A47L 9/2852* (2013.01); *A47L 9/2857* (2013.01); *A47L 2201/00* (2013.01)

(58) Field of Classification Search
CPC ..... A47L 9/1409; A47L 9/149; A47L 9/1683; A47L 9/2826; A47L 9/2831; A47L 9/2852; A47L 9/2857; A47L 2201/00
See application file for complete search history.

(56) References Cited

U.S. PATENT DOCUMENTS

| | | | | |
|---|---|---|---|---|
| 9,326,654 | B2 | 5/2016 | Doughty | |
| 2003/0182758 | A1 | 10/2003 | Hisano et al. | |
| 2005/0102790 | A1 | 5/2005 | Matsuno et al. | |
| 2007/0143950 | A1 | 6/2007 | Lin | |
| 2012/0311813 | A1* | 12/2012 | Gilbert, Jr. | A47L 9/0477 15/347 |
| 2013/0086760 | A1 | 4/2013 | Han et al. | |
| 2013/0276263 | A1* | 10/2013 | Feng | A47L 9/04 15/347 |
| 2014/0201941 | A1* | 7/2014 | Oka | A47L 5/22 15/340.1 |
| 2014/0230179 | A1* | 8/2014 | Matsubara | A47L 7/04 15/319 |
| 2014/0237757 | A1 | 8/2014 | Conrad | |
| 2014/0259475 | A1 | 9/2014 | Doughty | |
| 2015/0107037 | A1 | 4/2015 | Gilbert, Jr. et al. | |
| 2015/0250367 | A1 | 9/2015 | Van Der Kooi et al. | |
| 2016/0051108 | A1* | 2/2016 | Huang | A47L 9/2857 15/347 |
| 2016/0213217 | A1 | 7/2016 | Doughty | |
| 2016/0235270 | A1* | 8/2016 | Santini | A47L 9/0411 |
| 2017/0020355 | A1* | 1/2017 | Wennerstrom | A47L 9/122 |
| 2017/0100007 | A1* | 4/2017 | Matsumoto | A47L 9/00 |
| 2018/0049613 | A1* | 2/2018 | Tsuboi | A47L 9/28 |
| 2018/0177367 | A1* | 6/2018 | Amaral | A47L 9/1683 |

FOREIGN PATENT DOCUMENTS

| | | | |
|---|---|---|---|
| CN | 101152062 | A | 4/2008 |
| CN | 102379658 | A | 3/2012 |
| CN | 102415854 | A | 4/2012 |
| CN | 102727144 | A | 10/2012 |
| CN | 103156547 | A | 6/2013 |
| CN | 203662684 | U | 6/2014 |
| CN | 104224054 | A | 12/2014 |
| CN | 204950812 | U | 1/2016 |
| CN | 105982621 | A | 10/2016 |
| CN | 205903225 | U | 1/2017 |
| DE | 102013104255 | A1 | 10/2014 |
| WO | WO-2013/002599 | A2 | 1/2013 |
| WO | WO-2015/090439 | A1 | 6/2015 |

OTHER PUBLICATIONS

Partial European Search Report issued in Application No. 17164318.2, mailed from the European Patent Office, dated Nov. 9, 2017.
International Search Report of PCT/CN2016/107518, mailed from the State Intellectual Property Office of China dated Mar. 8, 2017.

* cited by examiner

AUTONOMOUS CLEANING DEVICE AND WIND PATH STRUCTURE OF SAME

CROSS-REFERENCE TO RELATED APPLICATIONS

This application is based on and claims priority to Chinese Patent Application No. 201610232735.6, filed Apr. 14, 2016, which is incorporated herein by reference in its entirety.

TECHNICAL FIELD

The present disclosure generally relates to smart home technology and, more particularly, to an autonomous cleaning device and a wind path structure of the autonomous cleaning device.

BACKGROUND

With the development of smart home technology, various autonomous cleaning devices, such as auto-sweeping robots, auto-mopping robots, and the like, have emerged. The autonomous cleaning devices can perform cleaning operations automatically without human supervision, and thus bring convenience to their users. For example, an auto-sweeping robot automatically cleans an area by employing automated brushing, sweeping, and vacuum cleaning technologies.

SUMMARY

According to a first aspect of the present disclosure, there is provided a wind path structure for use in an autonomous cleaning device, comprising: a cleaning component for cleaning cleaned objects, a cleaned object storage container for storing the cleaned objects, and a power component for generating a wind, the cleaning component, the cleaned object storage container, and the power component being arranged sequentially in a moving direction of the autonomous cleaning device; a first-level wind duct located between the cleaning component and the cleaned object storage container, wherein the first-level wind duct is coupled with the power component such that the cleaned objects are delivered to the cleaned object storage container by the wind generated by the power component; and a second-level wind duct located between the cleaned object storage container and the power component, wherein the second-level wind duct has a bell-mouth shape and includes an inner wall, the inner wall including an arc-shaped segment facing toward the wind coming from the cleaned object storage container to direct the wind to an air inlet of the power component. According to a second aspect of the present disclosure, there is provided an autonomous cleaning device, comprising a wind path structure including: a cleaning component for cleaning cleaned objects, a cleaned object storage container for storing the cleaned objects, and a power component for generating a wind, the cleaning component, the cleaned object storage container, and the power component being arranged sequentially in a moving direction of the autonomous cleaning device; a first-level wind duct located between the cleaning component and the cleaned object storage container, wherein the first-level wind duct is coupled with the power component such that the cleaned objects are delivered to the cleaned object storage container by the wind generated by the power component; and a second-level wind duct located between the cleaned object storage container and the power component, wherein the second-level wind duct has a bell-mouth shape and includes an inner wall, the inner wall including an arc-shaped segment facing toward the wind coming from the cleaned object storage container to direct the wind to an air inlet of the power component.

BRIEF DESCRIPTION OF THE DRAWINGS

The accompanying drawings, which are incorporated in and constitute a part of this specification, illustrate embodiments consistent with the invention and, together with the description, serve to explain the principles of the invention.

DETAILED DESCRIPTION

Exemplary embodiments will now be described in detail, examples of which are illustrated in the accompanying drawings. The following description refers to the accompanying drawings in which the same numbers in different drawings represent the same or similar elements unless otherwise described. The implementations set forth in the following description of the exemplary embodiments do not represent all implementations consistent with the present disclosure. Instead, they are merely examples of devices and methods consistent with aspects of the present disclosure as recited in the appended claims.

Figure 1:
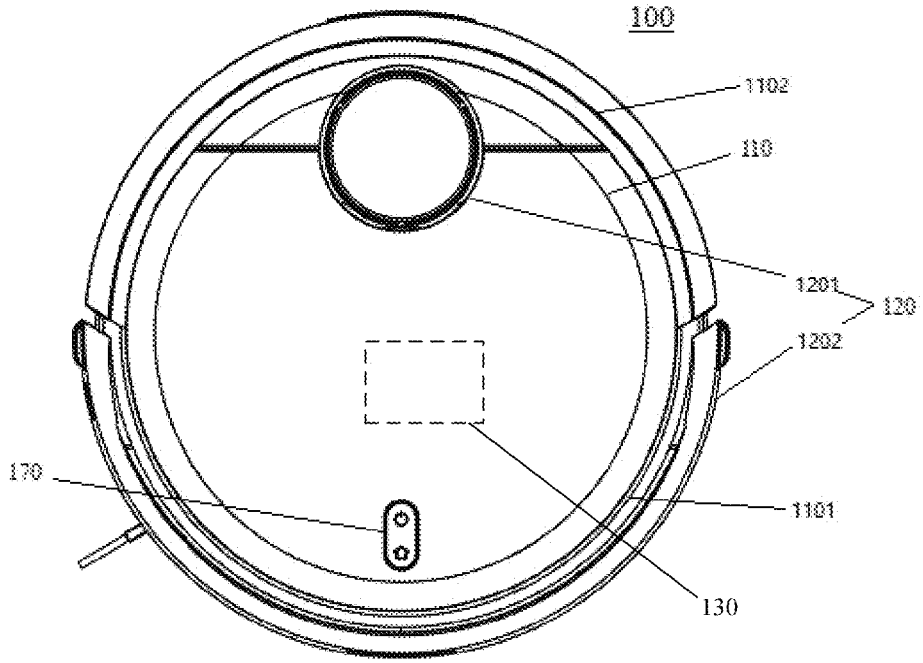
FIG. 1 is a schematic diagram illustrating a top view of a robot, according to an exemplary embodiment.
Figure 2:
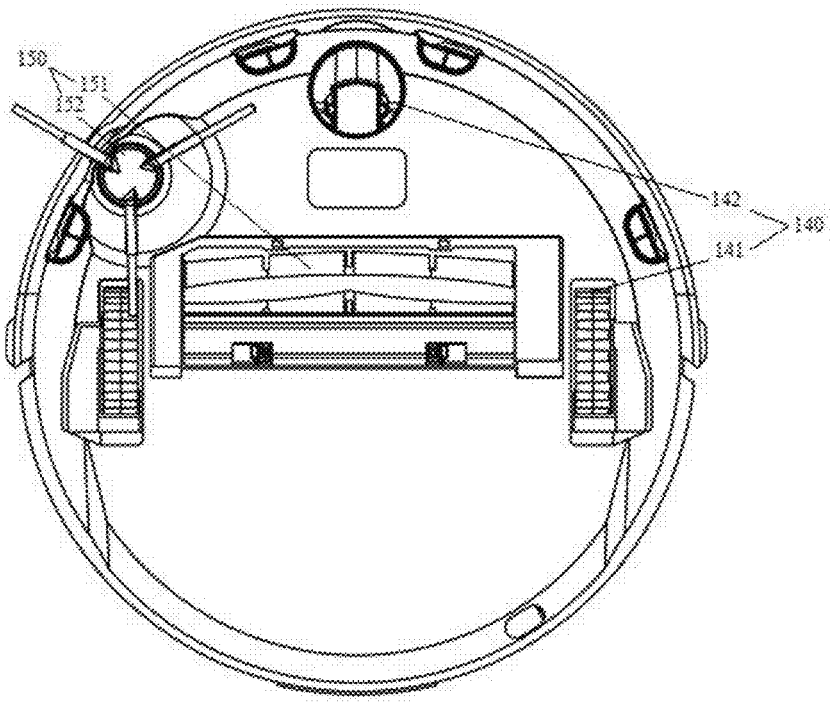
FIG. 2 is a schematic diagram illustrating a bottom view of the robot shown in FIG. 1, according to an exemplary embodiment.
Figure 3:
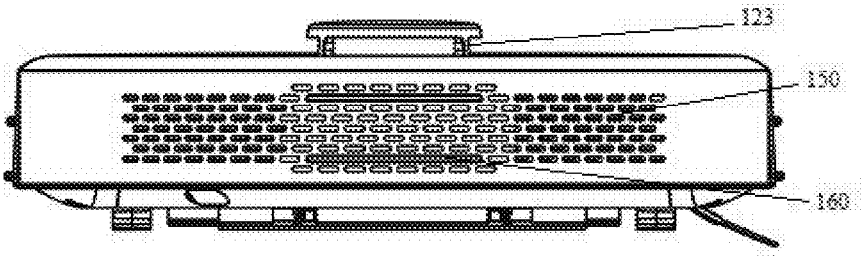
FIG. 3 is a schematic diagram illustrating a side view of the robot shown in FIG. 1, according to an exemplary embodiment.

FIGS. 1-4 are schematic diagrams illustrating, respectively, a top view, a bottom view, a side view, and a three-dimensional view of a robot 100, according to an exemplary embodiment. For example, the robot 100 is an autonomous cleaning device, such as a sweeping robot, a mopping robot, and the like. Referring to FIGS. 1-3, the robot 100 includes a robot body 110 (FIG. 1), a sensor system 120 (FIGS. 1 and 3), a control system 130 (FIG. 1), a drive system 140 (FIG. 2), a cleaning system 150 (FIGS. 2 and 3), an energy system 160 (FIG. 3), and a human-machine interaction system 170 (FIG. 1).

The robot body 110 includes a front part 1101 and a rear part 1102. The robot body 110 can have any shape. For example, the robot body 110 can have a nearly circular shape (i.e., each of the front part 1101 and the rear part 1102 form segments of the circle). The robot 100 may also have other shapes, including but not limited to a proximate D-shape (e.g., the front part 1101 has a flat outer surface and the outer surface of the rear part 1102 forms an arc).

The sensor system 120 includes a position determination device 1201 located above the robot body 110, a bumper sensor 1202 disposed on the front part 1101 of the robot body 110, a cliff sensor 1203 (not shown in the figures), an ultrasonic sensor (not shown), an infrared sensor (not shown), a magnetometer (not shown), an accelerometer (not shown), a gyroscope (not shown), an odometer (not shown), and the like. These components of the sensor system 120 provide various position information and motion information to the control system 130. For example, the cliff sensor 1203 is configured to sense an edge beyond which the robot 100 drops to a lower elevation. The position determination device 1201 includes but is not limited to a camera, a laser ranging device (LDS), etc.

The front part 1101 of the robot body 110 bears the bumper sensor 1202. When the robot 100 moves on the floor in a cleaning process, the bumper sensor 1202 detects one or more events (or objects), such as an obstacle, a wall, and the like, in the moving path of the robot 100. The bumper sensor 1202 may include a sensor for detecting the events/objects or detect the events/objects via one or more of the above-described sensors in the sensor system 120, such as the infrared sensor. As describe in more detail below in connection with the drive system 140, the robot 100 is propelled by a wheel driving module 141. In the disclosed embodiments, the robot 100 is configured to control the wheel driving module 141 in response to the events/objects detected by the bumper sensor 1202, so as to move away from or circumvent obstacles in the moving path of the robot 100.

The control system 130 is integrated on a circuit board in the robot body 110. The control system 130 includes a processor and a memory. In some embodiments, the processor is a central processing unit or an application specific processor in communication with the memory. The memory may be a hard disk, a flash memory, a random access memory, etc.

The memory includes a non-transitory computer readable storage medium storing instructions executed by the processor to implement the above-described methods described herein. For example, the processor can implement a positioning algorithm, such as a Simultaneous Localization and Mapping (SLAM) algorithm, to generate a real-time map of the surrounding environment of the robot 100, based on the obstacle information detected by the laser ranging device. Moreover, by combining the distance information and/or speed information detected by the bumper sensor 1202, the cliff sensor 1203, the ultrasonic sensor, the infrared sensor, the magnetometer, the accelerometer, the gyroscope, and/or the odometer, the processor can determine the current operation state of the robot 100, such as whether the robot 100 moves across a door threshold, moves on a carpet, moves close to a cliff, gets stuck, has a full dust box, is picked up by a user, and the like. The processor can also plan the next actions to be performed by the robot 100 based on the current operation state of the robot 100, such that the operations of the robot 100 can meet the user's requirement. Furthermore, the processor can plan a most effective and reasonable cleaning path and/or cleaning mode for the robot 100, based on the real-time map of the environment surrounding the robot 100, so as to improve the cleaning efficiency.

The drive system 140 drives the robot 100 to move on the ground based on a drive command which includes distance and angle information (e.g., x, y, and θ components) of the robot 100. The drive system 140 includes a driving wheel module 141 for controlling a left wheel and a right wheel of the robot 100. In some embodiments, the driving wheel module 141 controls the left wheel and right wheel at the same time. In some embodiments, the driving wheel module 141 further includes a left driving wheel module and a right driving wheel module for driving the left and right wheels respectively, so as to more preciously control the movement of the robot 100. The left and right driving wheel modules are oppositely arranged along a lateral axis of the robot body 110. In some embodiments, to improve the stability and/or maneuverability of the robot 100, the robot 100 further includes one or more non-driving wheels 142, for example, one or more universal wheels.

The driving wheel module 141 includes the driving wheel (s), one or more driving motors associated with the driving wheel(s), and a control circuit for controlling the driving motor(s). In some embodiments, the driving wheel module 141 is also connected with the odometer and/or a circuit for measuring the current supplied to the driving motor(s). The driving wheel module 141 is removable from the robot body 110, such that the driving wheel module 141 can be detached from the robot body 110 for maintenance or repair. In some embodiments, each driving wheel has an offset drop-down suspension system, through which the driving wheel can be fastened on the robot body 110 and kept movable or rotatable. The driving wheel receives a spring offset extending downward and away from the robot body 110. The spring offset enables the driving wheel to contact with and grip the ground with a non-zero force, and the cleaning components of the robot 100 to maintain contact with the ground with a non-zero pressure.

The cleaning system 150 may be a dry cleaning system, a wet cleaning system, or a combination of both. For illustrative purpose only, the following description assumes the cleaning system 150 is a dry cleaning system. However, it is contemplated that the cleaning system 150 may be alternatively or additionally configured as a wet cleaning system. The cleaning system 150 includes a sweeping system 151 for performing the cleaning function of the robot 100. In the disclosed embodiments, the sweeping system 151 includes a main brush (e.g., a brush roll), a dust box, a fan, an air outlet, and connection elements for connecting the main brush, dust box, fan, and air outlet. During operation, the main brush forms contact with the ground. Dust on the ground is swept and rolled up by the main brush to the front of a dust suction inlet located between the main brush and the dust box, and then sucked into the dust box by a wind (i.e., airflow) passing through the dust box. The wind is generated by the fan. In some embodiments, the cleaning system 150 further includes a side brush 152. The side brush 152 has a rotation axis forming a non-zero angle with the ground, such that the side brush 152, when rotating, can move debris into the area reachable by the main brush of the sweeping system 151.

The dust suction ability of the robot 100 is also known as the Dust Pickup Efficiency (DPU). The DPU is determined by many factors, including but not limited to: the structure of the main brush and the material for making the brush; the efficiency of using the wind through the dust suction inlet, the dust box, the fan, the air outlets, and the connection elements between these components; and the type and power of the fan. As such, improving the DPU is a complex system design problem. Compared with common corded dust cleaners, improving the DPU has more significance to the robot 100, whose energy supply is limited. This is because the improvement of the DPU can directly reduce the energy required by the robot 100 for cleaning the dust in each unit area. For example, with the improvement of the DPU, the area capable of being cleaned by a fully charged robot 100 may increase from 80 $m^2$ to 180 $m^2$ or more. Moreover, the improvement of the DPU extends the service life of the battery by reducing the frequency of recharging the battery, so that the user does not need to frequently replace the battery. Furthermore, the improvement of the DPU directly affects the user experience, because users can directly judge if the ground swept or mopped by the robot 100 is clean enough.

The energy system 160 includes a rechargeable battery, such as a nickel-metal hydride battery or a lithium battery. The rechargeable battery is connected with one or more of a charging control circuit, a charging temperature detection circuit (for detecting the battery temperature during charging), or a low voltage detection circuit (for detecting whether the voltage of the rechargeable battery drops to a predetermined level). These circuits are further connected with a microprocessor control circuit (e.g., a microprocessor control circuit in the control system 130. The rechargeable battery is charged by connecting a charging electrode on the side or the bottom of the robot body 110 to a charging source. In some embodiments, the charging electrode is located at a position on the robot body 110 that is not directly exposed to dust. This is because dust adhered to the charging electrode may lead to charge accumulation on the charging electrode, which further causes plastic material around the charging electrode to be melt and deformed, or even the charging electrode itself to be distorted.

The human-machine interaction system 170 includes a user panel which houses various buttons/keys for a user to select function(s) to be performed by robot 100. The human-machine interaction system 170 also includes various output devices, such as a display, an indicator light, and/or a speaker, for indicating the current state of the robot 100 or the function(s) selected by the user. In some embodiments, the human-machine interaction system 170 further includes a mobile client device, such as a mobile phone. The mobile client device is installed with a mobile client application, which can be used by the user to interact with the robot 100. For example, if the robot 100 is capable of path navigation, the mobile client device may display a map of an area surrounding the robot 100 and mark the position of the robot 100 on the map, so as to provide rich information to the user and make the robot 100 user friendly.

Figure 4:
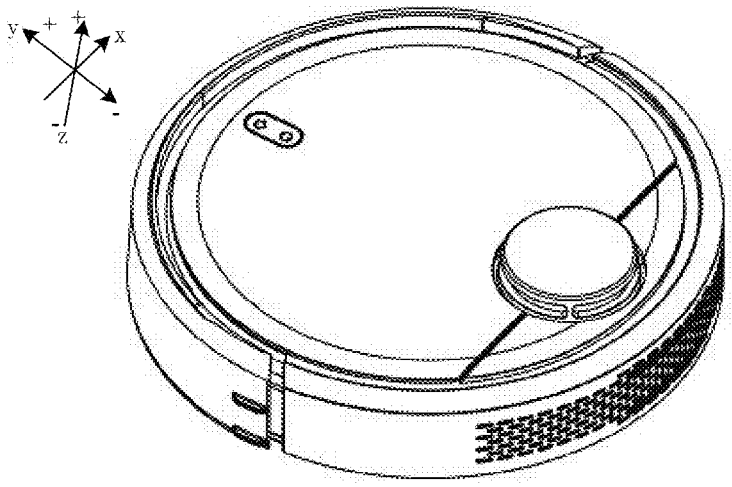
FIG. 4 is a schematic diagram illustrating a three-dimensional view of the robot shown in FIG. 1, according to an exemplary embodiment.

In order to clearly describe the behaviors (e.g., moving direction) of the robot 100, the present disclosure defines three axes with respect to the robot body 110. Referring to FIG. 4, the three axes are perpendicular to each other, and include: a lateral axis x, a forward-backward axis y, and a vertical axis z. Specifically, the +y direction is defined as the "forward direction", and the −y direction is defined as the "backward direction". The x axis extends between the left wheel and the right wheel of the robot 100 and across the center point of the driving wheel module 141. The robot 100 can rotate around the x axis. For example, when the front part 1101 of the robot body 110 tilts upward and the rear part 1102 of the robot body 110 tilts downward, this movement is defined as "nose up pitch." When the front part 1101 of the robot body 110 tilts downward and the rear part of the robot body 110 tilts upward, the movement is defined as "nose down pitch." In addition, the robot 100 may rotate around the z axis. When the robot 100 moves in the forward direction (i.e., +y direction), a turn of the robot 100 to the right side of the +y direction is defined as a "right turning" of the robot 100 around the z axis to the right side toward the y axis, and a turn of the robot 100 to the left side of the +y direction is defined as a "left turning" of the robot 100 around the z axis.

In the technical solution of the present disclosure, an optimized wind path structure will be achieved by improving the clean system 150 of the robot 100, such that in the same power conditions, the airflow loss in the wind path structure can be reduced and the dust pick up efficiency can be improved. The technical solution of the present disclosure will be described in conjunction with embodiments.

Figure 11:
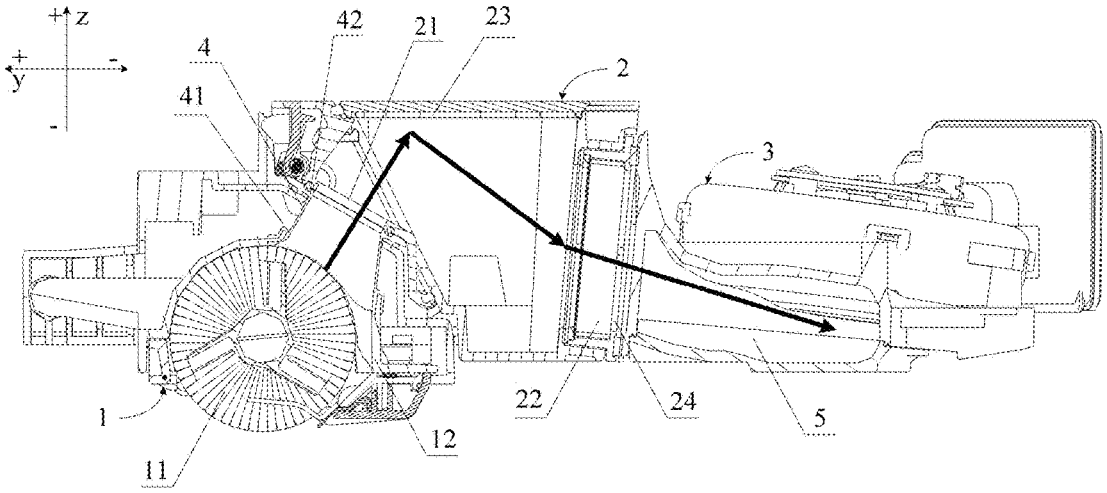
FIG. 11 is a schematic diagram illustrating a cross-sectional view of a wind path structure of an autonomous cleaning device, according to an exemplary embodiment.

FIG. 11 is a schematic diagram illustrating a cross-sectional view of a wind path structure of an autonomous cleaning device, according to an exemplary embodiment. Consistent with the disclosed embodiments, for example, the autonomous cleaning device is the robot 100 shown in FIGS. 1-4, and the wind path structure constitutes a part or the whole of the cleaning system 150 of the robot 100. For the convenience of description, FIG. 11 also uses the y and z axes to show the direction information of the autonomous cleaning device. Specifically, the forward moving direction of the autonomous cleaning device is along the +y direction, and the backward moving direction is along the −y direction. Moreover, the z axis shows the vertical direction.

As shown in FIG. 11, the wind path structure includes a cleaning component 1, a cleaned object storage component 2 (e.g., a cleaned object storage container), a power component 3, a first-level wind duct 4, and a second-level wind duct 5. The cleaning component 1, the cleaned object storage component 2, and the power component 3 are sequentially arranged along the moving direction of the autonomous cleaning device (i.e., along the y axis). The first-level wind duct 4 is arranged between the cleaning component 1 and the cleaned object storage component 2, and the second-level wind duct 5 is arranged between the cleaned object storage component 2 and the power component 3. As such, the wind path structure forms the following wind path: the cleaning component 1→the first-level wind duct 4→the cleaned object storage component 2→the second-level wind duct 5→the power component 3. Along this wind path, a wind generated by the power component 3 flows from the cleaning component 1 to the power component 3. The flow direction of the wind is shown by the dark arrows in FIG. 11. When the wind generated by the power component 3 flows along the cleaning component 1, the first-level wind duct 4, and the cleaned object storage component 2, the cleaned objects, such as dusts, granular garbage, and the like, are delivered by the wind to the cleaned object storage component 2, to achieve the cleaning operation of the autonomous cleaning device.

As described above, the DPU is the accurate representation of the cleaning ability of the autonomous cleaning device, and is determined by a sweeping efficiency of the main brush and the suction efficiency of the autonomous cleaning device. The suction efficiency, which is the accurate representation of the dust suction ability, will be mainly discussed herein. The suction efficiency shows the efficiency of transforming electrical energy into mechanical energy: The suction efficiency is determined according to the following equation: suction efficiency=suction power/input power, wherein the input power is the input power of a fan motor for generating a wind, and suction power=wind volume*vacuum degree. When the input power increases to a certain level, a wind volume for picking up dust is generated. With the increase of the input power, the wind volume increases while the vacuum degree decreases, such that the input power first increases and then decreases. Thus, in the disclosed embodiments, the input power is set in a range which leads to a high suction power.

For a given input power, the larger the wind volume and the vacuum degree are, the higher the suction efficiency is. To reduce the loss of the vacuum degree, measures for avoiding air leakage in the wind path structure, e.g., sealing treatment, may be used. To reduce the loss of the wind volume, the wind path structure may be configured to provide a smooth wind path without abrupt changes. Specifically, consideration for the wind path structure includes: whether the wind enters a wind duct from the bottom of the main brush without loss; the number of times which the wind is reflected at a large angle when the wind blows from the bottom of the main brush to the fan through the dust box; whether significant air turbulence is generated by the change of the cross-sectional area of the wind duct; and so on. The wind path structure is an integral structure. A structure change in one component of the wind path structure could lead to a great change in the dust suction efficiency of the autonomous cleaning device.

Still referring to FIG. 11, in some embodiments, the cleaning component 1 is a main brush. The bigger the size of the main brush, the bigger the area cleaned by the main brush. The cleaned object storage component 2 is a dust box. The dust box and the moving wheels of the autonomous cleaning device are located inside the housing of the autonomous cleaning device. Thus, the dust box cannot have a large size due to the limitation of the housing. In addition, in order to increase the vacuum net pressure for sucking dust into the dust box, the air inlet of the dust box cannot be too wide. As such, the first wind duct 4 is arranged between the main brush and the dust box, and the cross-sectional area of the first wind duct 4 decreases gradually. The exit of the dust box is installed with a mesh filter to filter air. Generally, the exit of the dust box has a large cross-sectional area to avoid blockage of the filter. The power component 3 is a fan. The air inlet of the fan has a radius much smaller than the radius of the exit of the dust box. As such, the second wind duct 5 is arranged between the dust box and the fan. Similar to the first wind duct 4, the cross-sectional area of the second wind duct 5 also decreases gradually. Some existing autonomous cleaning devices, such as the Roomba® series sweeping robot from iROBOT® (see, e.g., https://www.irobot.com/For-the-Home/Vacuuming/Roomba.aspx), employ wind path structures including two wind ducts. However, the existing autonomous cleaning devices do not have optimized structures for these two wind ducts. In particular, although the existing autonomous cleaning devices may include a main brush, a dust box, a fan, and even two wind ducts with gradually reduced cross-sectional area, difference in the shapes of the wind ducts could lead to different suction efficiencies.

As described in more detail below, the wind path structure in the present disclosure enables wind to enter into a wind duct from the bottom of a floating main brush. The floating main brush can closely contact the ground even if the ground surface is rugged. Thus, the loss of wind volume at the floating main brush is small. The floating main brush is achieved by using flexible material for the first-level wind duct and using a structure design that enables the main brush to move up and down with the changing surface level of the ground.

The wind enters the first-level wind duct through a main brush bin. The shape of the first-level wind duct makes the net pressure value of the wind increase smoothly, and the dust/garbage is moved up to the dust box. The first-level wind duct is tilted, such that the wind entering the dust box is reflected by the inner top of the dust box at a large reflection angle and then leaves the dust box. That is, the garbage in the dust box falls to the bottom of the dust box, and the wind flowing obliquely upward is reflected by the inner top of the dust box and blows out through the filter mesh. The wind then enters the second-level wind duct. The design purpose of the second-level wind duct is to reduce the loss of the wind through the filter mesh and enable the wind to enter the fan inlet in a predefined direction.

The structure of each component in the wind path structure is described in detail in the following.

1. The Structure of the Cleaning Component 1

Figure 5:
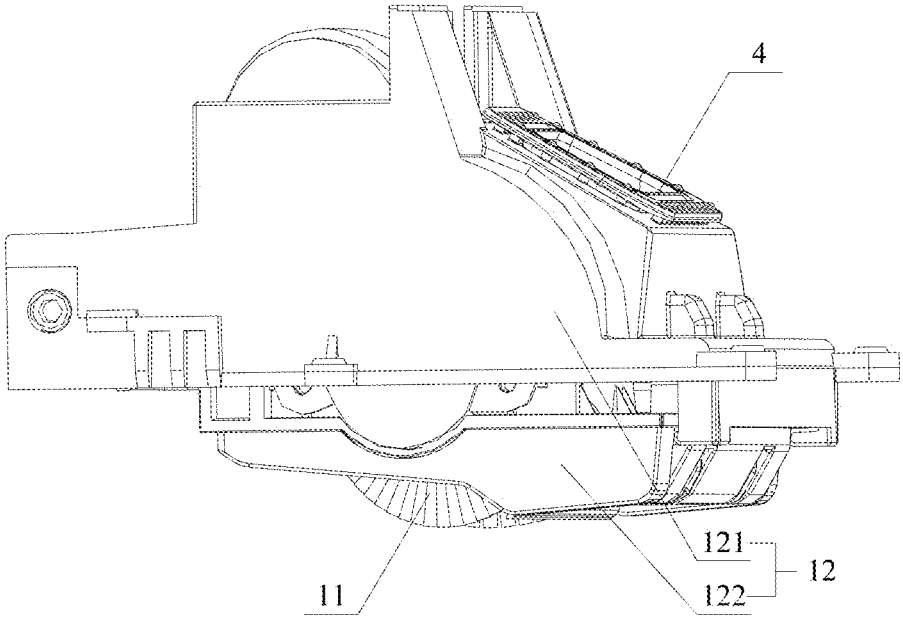
FIG. 5 is a schematic diagram illustrating a three-dimensional view of a main brush assembly, according to an exemplary embodiment.
Figure 6:
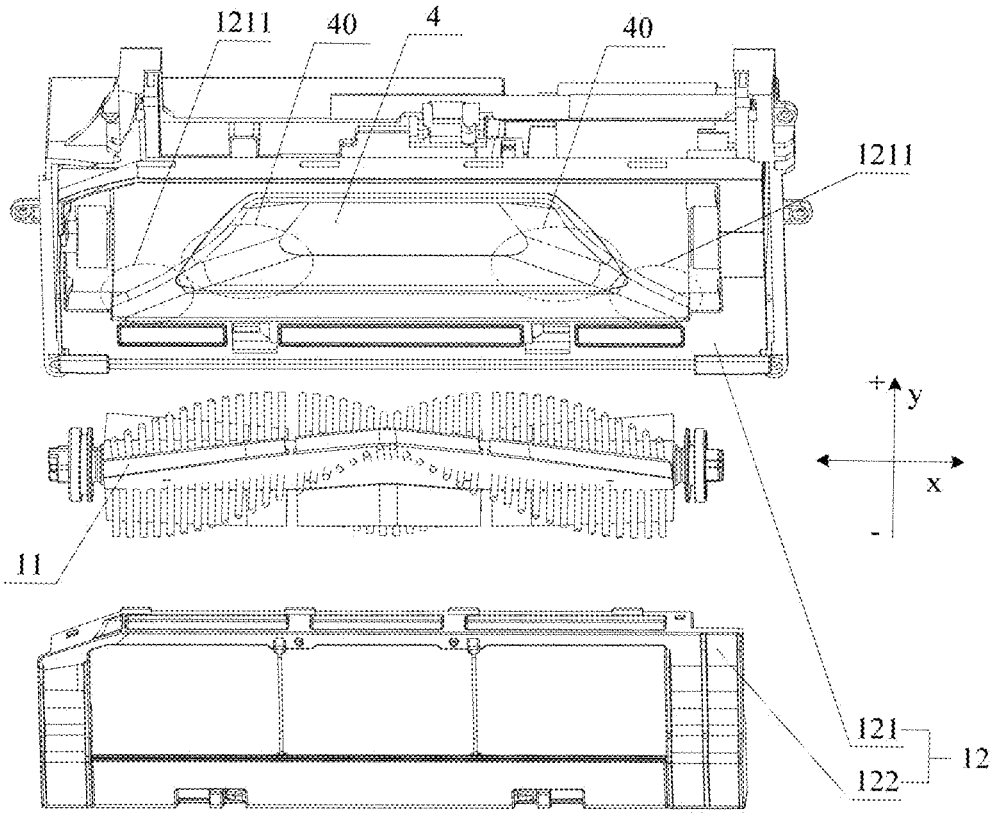
FIG. 6 is a schematic diagram illustrating an exploded structural view of the main brush assembly shown in FIG. 5, according to an exemplary embodiment.
Figure 7:
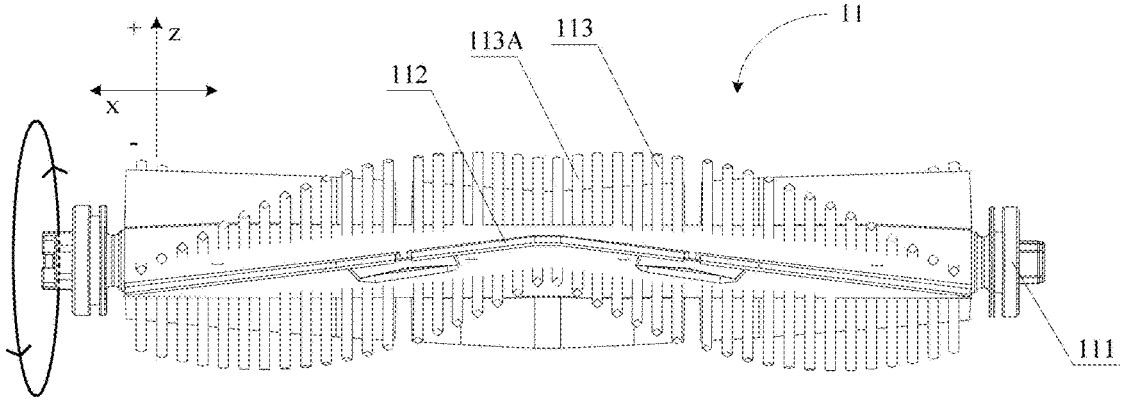
FIG. 7 is a schematic diagram illustrating a main brush of the main brush assembly shown in FIG. 5, according to an exemplary embodiment.

In some embodiments, the cleaning component 1 of the autonomous cleaning device is configured to be a main brush. FIG. 5 is a schematic diagram illustrating a three-dimensional view of a main brush assembly, according to an exemplary embodiment. FIG. 6 is a schematic diagram illustrating an exploded structural view of the main brush assembly shown in FIG. 5, according to an exemplary embodiment. The view of the main brush assembly illustrated in FIG. 6 is along the +z axis (i.e., bottom-up direction). As shown in FIGS. 6 and 7, the main brush assembly includes a main brush 11 and a main brush bin 12. The main brush bin 12 further includes a floating system support 121 and a main brush cover 122.

1) Main Brush

FIG. 7 is a schematic diagram illustrating a structure of the main brush 11, according to an exemplary embodiment. As shown in FIG. 7, the main brush 11 in the main brush assembly may be a rubber-hair mixed brush. That is, a rotation shaft 111 of the main brush 11 is arranged with a rubber brush element 112 and a hair brush element 113. The combination of the rubber brush element 112 and the hair brush element 113 enables the cleaning of various environments, such as a floor, a blanket, a carpet, and the like. The directions in which the hair brush of the hair brush element 113 and the rubber bars of the rubber brush element 112 extend are almost the same with the radial direction of the rotation shaft 111. The widths of the rubber bar of the rubber brush element 112 and the hair brush of the hair brush element 113 are approximately the same as the width of an air inlet 41 (see FIG. 11) of the first-level wind duct 4. As shown in FIG. 7, rubber brush element 112 is bent upward in the middle, and the hair brush element 113 has a wave shape. In the disclosed embodiments, the main brush 11 may have at least one rubber brush element 112 and at least one hair brush element 113.

In some embodiments, the rubber brush element 112 and the hair brush element 113 are not arranged in parallel or substantially in parallel. Rather, there is a large angle formed between the rubber brush element 112 and the hair brush element 113, so as to enable the rubber brush element 112 and the hair brush element 113 to achieve their respective functions.

(1) The Rubber Brush Element 112

Because there is large gaps between hair tufts 113A of the hair brush element 113, wind may easily flow through the gaps. This is not useful for forming a vacuum environment. Therefore, the rubber brush element 112 is arranged to achieve the effect of maintaining the wind. When the intensity of the maintained wind reaches a preset level, the rubber brush element 112 can assist with sweeping the cleaned object. This way, the cleaned objects can be easily delivered to the cleaned object storage component 2 by both the sweeping of the main brush 11 and the blowing of the wind.

Consistent with the disclosed embodiments, the ability of the rubber brush element 112 in maintaining the wind is positively correlated to the angle between the rubber brush element 112 on the cylindrical surface of the main brush 11 and the rotation shaft 111. For example, in an extreme case, the rubber brush element 112 is aligned along the rotation shaft 111 (i.e., along the x axis shown in FIG. 7). In this case, the rubber brush element 112 can maintain the wind at the largest designed intensity.

In the disclosed embodiments, the angle between the rubber brush element 112 and the rotation shaft 111 is set to keep the amount of the wind maintained by the rubber brush element 112 above a predetermined level. Moreover, the arrangement of the rubber brush element 112 may also consider other factors. For example, as shown in FIG. 7, the rubber brush element 112 is not arranged in an exactly straight line. Rather, the rubber brush element 112 is extended in a substantially straight line on the cylindrical surface of the main brush 11, with a central part of the rubber brush element 112 being bent opposite to the rotating direction of the main brush 11 (i.e., bent toward the moving direction of the robot 100). That is, as shown in FIG. 7, the rubber brush element 112 forms a wave-like shape which includes a crest part (i.e., the bent central part of the rubber brush element 112). As such, viewing the rotation of the rubber brush element 112 along the negative direction of the x axis while the main brush 11 is working (i.e., while the robot 100 is moving), the crest part (i.e., the bent central part) of the rubber brush element 112 arrives at the suction inlet (air inlet of the first-level wind duct 4) of the robot 100 later than the other parts of the rubber brush element 112. This way, the wind generated by the power component 3 is concentrated at the bent central part of the rubber brush element 112, and is better able to gather the cleaned objects. In addition, a rubber brush element 112 having a completely straight line shape can only maintain a maximum amount of wind for a brief moment, while a rubber brush element 112 with a bending angle can maintain a maximum amount of wind for a longer period.

As shown in FIG. 6, in some embodiments, the first-level wind duct 4 is located obliquely above the main brush bin 12. Along the x axis (i.e., left-right direction of the autonomous cleaning device), the width of the first-level wind duct 4 is shorter than the width of the main brush 11. With this configuration, the first-level wind duct 4 can achieve a higher vacuum net pressure value using a given wind volume, so as to more efficiently deliver the cleaned objects to the cleaned object storage component 2. Meanwhile, the main brush 11 can cover a larger cleaned area. Thus, the size difference of the first-level wind duct 4 and the main brush 11 is used as a design strategy for improving the cleaning efficiency. Moreover, with proper design of the shape of the rubber brush element 112, the wind can concentrate in the middle part of the rubber brush element 112. Such a shape, together with the above-described size difference between first-level wind duct 4 and the main brush 11, ensure all the cleaned objects swept by the main brush 11 to be delivered to the first wind duct 4 and be further delivered to the cleaned object storage component 2.

Still referring to FIG. 6, the floating system support 121 has an arc structure 1211 arranged from an air inlet (the bottom of FIG. 6) to the first-level wind duct 4 for guiding the wind. The arc structure 1211 has a same curvature with an arc shape 40 of the first-level wind duct 4. The arc structure 4 improves the efficiency of guiding the wind into the first-level wind duct 4, and reduces the loss of wind.

(2) The Hair Brush Element 113

Referring to FIG. 7, in the disclosed embodiments, the hair brush element 113 forms a large deflection angle with the direction of the rotation axis on the cylindrical surface of the main brush 11. With the large deflection angle, when hair tufts 113A of the hair brush element 113 are arranged in turn along the rotation axis, a large coverage angle of the hair brush element 113 along the circumference of the cylindrical surface of the main brush 11 may be achieved. For example, a proper deflection angle may be selected to achieve a preset coverage angle along the circumference.

The cleanliness and the cleaning efficiency can be improved by increasing the coverage angle along the circumference of the main brush 11. The main brush 11 is rolled to clean the ground. As such, when the hair brush element 113 has a 360° coverage angle along the circumference of the main brush 11, the main brush 11 can perform the cleaning operation all the time.

Moreover, with the increase of the deflection angle between the hair brush element 113 and the rotating axis and thus the increase of the coverage angle of the hair brush element 113 along the circumference of the main brush 11, fewer hair brush elements 113 are required to achieve a given circumferential coverage angle. For example, assuming that a 360° coverage angle along the circumference of the main brush 11 is desired, if the circumferential coverage angle of each hair brush element 113 is 60°, then 6 hair brush elements 113 are needed. In contrast, if the circumferential coverage angle of each hair brush element 113 is 120°, only 3 hair brush elements 113 are needed. Therefore, the number of needed hair brush elements 113 can be decreased by increasing the deflection angle between the hair brush element 113 and the rotating axis. This helps reduce the production cost of the main brush 11 without affecting the cleaning effect.

Moreover, the hair brush element 113 is required to contact the ground during cleaning. Specifically, the hair brush element 113 is made from flexible material such that the hair brush element 113 can be deformed during the cleaning process to support the whole autonomous cleaning device. If the coverage angle of the hair brush element 113 along the circumference of the main brush 11 is not large enough, a height difference will be generated between the area forming the circumferential coverage and the area not forming the circumferential coverage, which leads to jolting or shaking along the z axis and adversely affects the cleaning operation. Therefore, when the hair brush elements 113 have a 360° circumferential coverage angle, the jolting or shaking may be eliminated. This not only causes the autonomous cleaning device to operate stably, but also reduces the noise generated by the autonomous cleaning device. Moreover, the shock to the autonomous cleaning device's electric motor(s) is reduced, such that the service life of the autonomous cleaning device is extended.

2) Main Brush Cover 122

Figure 8:
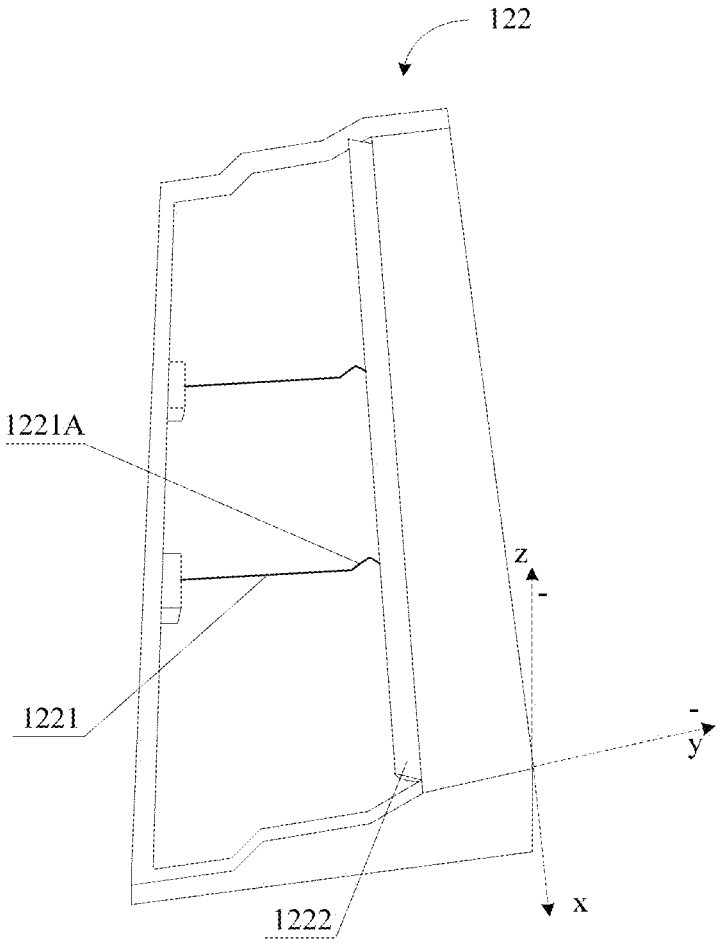
FIG. 8 is a schematic diagram illustrating a main brush cover of the main brush assembly shown in FIG. 5, according to an exemplary embodiment.

In some embodiments, the cleaning component 1 also includes a main brush cover 122. FIG. 8 is a schematic diagram illustrating a three-dimensional view of the main brush cover 122, according to an exemplary embodiment. Referring to FIG. 8, the main brush cover 122 includes an anti-winding guard 1221 and a soft rubber scraper bar 1222. In the moving direction of the autonomous cleaning device, the soft rubber scraper bar 1222 is located behind the anti-winding guard 1221. The anti-winding guard 1221 not only prevents objects larger than a certain size from getting into and blocking the first-level wind duct 4, but also prevents elongated objects, such as wires, from entering the main brush bin 12 and causing intertwinement.

Referring back to FIG. 5, the main brush cover 122 is located below the main brush 11 along the z axis, to prevent the large sized objects and/or elongated objects from being rolled into the main brush assembly and adversely affecting the normal cleaning operation of the autonomous cleaning device. The soft rubber scraper bar 1222 is located below the anti-winding guard 1221 along the z axis. Moreover, the soft rubber scraper bar 1222 is located at the rear end of the main brush 11 along the y axis, and is separated by a certain distance, e.g., 1.5 mm-3 mm, from the main brush 11. The soft rubber scraper bar 1222 contacts the ground to stop and scoop up some cleaned objects that are not rolled up by the main brush 11, such that these cleaned objects can be rolled up to the space between the main brush 11 and main brush bin 12 by the sweeping of the main brush 11 and the flow of the wind and then be delivered into the first-level wind duct 4. The location and angle of the soft rubber scraper bar 1222 are selected to make the cleaned objects always lie at the best positions for sweeping and sucking, so as to prevent the cleaned objects from being missed by the soft rubber scraper bar 1222.

As shown in FIG. 8, the anti-winding guard 1221 includes an obstacle-crossing accessory 1221A at a rear end of the anti-winding guard 1221 along the moving direction of the autonomous cleaning device. On one hand, the obstacle-crossing accessory 1221A provides the obstacle-crossing function of the autonomous cleaning device. On the other hand, the obstacle-crossing accessory 1221A abuts on the top surface of the soft rubber scraper bar 1222, to make the bottom edge of the soft rubber scraper bar 1222 touch the surface to be cleaned (e.g., floor, table surface, and the like) all the time when the autonomous cleaning device is in operation. This configuration prevents the soft rubber scraper bar 1222 from being rolled up by the cleaned objects on the surface to be cleaned, thus avoiding adverse effects to the subsequent cleaning.

Figure 9:
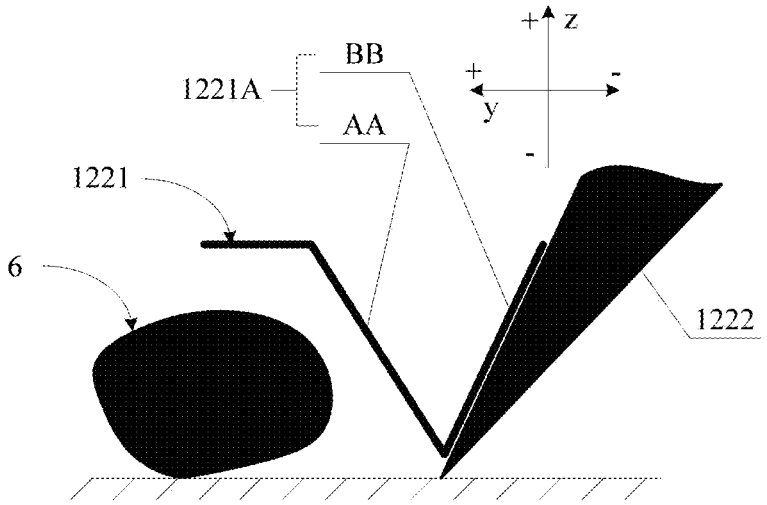
FIG. 9 is a schematic diagram illustrating a matching relationship between an obstacle-crossing accessory and a soft rubber scraper bar of the main brush assembly shown in FIG. 5, according to an exemplary embodiment.

In one embodiment, the obstacle-crossing accessory 1221A may be a downward protrusion at the rear end of the anti-winding guard 1221 in the moving direction (i.e., the negative direction of the z axis which is the "top" shown in FIG. 8). FIG. 9 is a schematic diagram illustrating a matching relation between the obstacle-crossing accessory 1221A and the soft rubber scraper bar 1222, according to an exemplary embodiment. As shown in FIG. 9, the protrusion of the obstacle-crossing accessory 1221A includes a first edge AA at a front end of the protrusion in the moving direction. When the autonomous cleaning device moves forward (i.e., moving from right to left in FIG. 9) and there is an obstacle 6 on the surface to be cleaned, the first edge AA tilts from left to right and cooperates with the floating system support 121, to direct the autonomous cleaning device to cross the obstacle 6 smoothly in an obstacle crossing process. This way, the autonomous cleaning device is not blocked by the the obstacle 6.

As shown in FIG. 9, the protrusion of the obstacle-crossing accessory 1221A also includes a second edge BB at a rear end of the protrusion in the moving direction, and the second edge BB abuts a top surface of the soft rubber scraper bar 1222. When the protrusion is constituted by the first edge AA and the second edge BB, the protrusion may be shaped as a corner with an acute angle, as shown in FIG. 9.

It should be noted that when the obstacle-crossing accessory 1221A employs the protrusion, a lowest point of the protrusion should not be lower than the bottom surface of the main brush cover 122, so as to avoid the autonomous cleaning device from rubbing the ground to generate additional resistance in the cleaning process of the autonomous cleaning device. This is helpful for improving the cleaning efficiency of the autonomous cleaning device.

3) The Floating System Support 121

Figure 10:
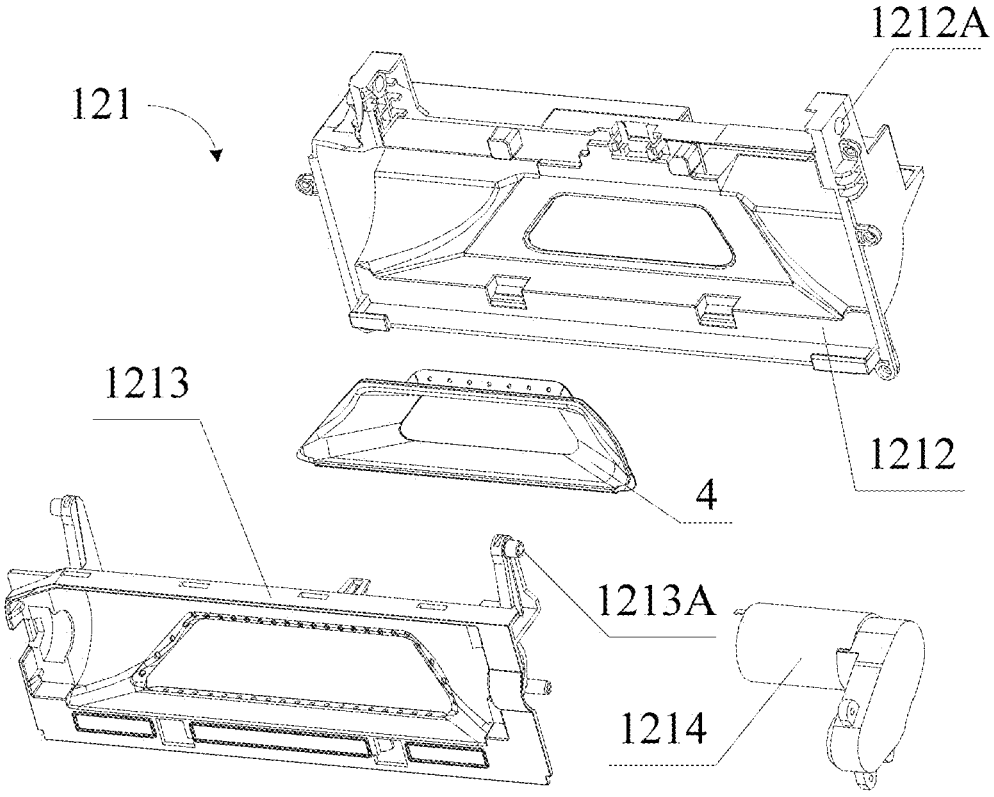
FIG. 10 is a schematic diagram illustrating an exploded structural view of a floating system support of the main brush assembly shown in FIG. 5, according to an exemplary embodiment.

FIG. 10 is a schematic diagram illustrating an exploded structural view of the floating system support 121, according to an exemplary embodiment. As shown in FIG. 10, the floating system support 121 includes a fixed support 1212 and a floating support 1213. The floating system support 121 is also arranged with the first-level wind duct 4 and a main brush electric motor 1214. The fixed support 1212 is arranged with two mounting holes 1212A in the left and right sides of the autonomous cleaning device, and the floating support 1213 is arranged with two mounting shafts 1213A. With the limit and rotation cooperation of the mounting shafts 1213A and corresponding mounting holes 1212A, the floating support 1213 can float up and down.

When the autonomous cleaning device is in the normal cleaning process, the floating support 1213 rotates to the lowest position under the influence of gravity. In the floating range of the main brush 11, the main brush 11 mounted in the floating system support 121 can closely attach to the ground to be cleaned, such as, floor, blanket, or any other rough surface, such that a peak cleaning efficiency could be achieved when the main brush 11 attaches to ground for cleaning. This way, the main brush 11 can better attach to the surface for various types of surface to be cleaned, which contributes to the sealing of the wind path structure.

When there is an obstacle 6 on the surface to be cleaned, the interaction of the main brush 11 and the obstacle 6 is reduced with the floating support 1213 floating up and down, so as to assist the autonomous cleaning device to cross the obstacle 6 easily. The first-level wind duct 4 is located between the fixed support 1212 and the floating support 1213, so the floating main brush 11 has a requirement for a soft first-level wind duct 4. This is because a hard first-level wind duct 4 does not allow the floating of the main brush 11. Such requirement may be achieved by using flexible material for the first-level wind duct 4. Therefore, when the first-level wind duct 4 is made from flexible materials, such as soft rubber and the like, the first-level wind duct 4 may be deformed when squeezed by the floating support 1213 in an obstacle-crossing process, such that the floating support 1213 can successfully float up.

In addition, when the surface to be cleaned is a rough surface, such as blanket, the friction between the main brush 11 and the blanket may be reduced by the floating function of the floating support 1213, such that the resistance to the electric motor 1214 of the main brush 11 may be reduced. This helps reduce the power consumption of the electric motor 1214 of the main brush 11 and extends the service life of the electric motor 1214.

2. The Structure of the First-Level Wind Duct 4

In the present disclosure, the first-level wind duct 4 is used to guide the wind generated by the power component 3, such that the wind delivers the cleaned objects swept by the cleaning component 1 to the cleaned object storage component 2.

Referring again to FIG. 11, the first-level wind duct 4 is shaped as a bell mouth. The area of the cross section of the first-level wind duct 4 is in inverse correlation with the distance from the cross section to the cleaning component 1. In other words, the larger side of the "bell mouth" faces the cleaning device and the smaller side of the "bell mouth" faces the cleaned object storage component 2.

As described above, the first-level wind duct 4 is shaped as a bell mouth, and the cross-sectional area of the first-level wind duct 4 decreases gradually as the distance from the cleaning component 1 increases. This way, the vacuum net pressure value, i.e., the suction power, increases along the first-level wind duct 4 in the direction away from the cleaning component 1. When the cleaned objects, such as dust, garbage, and the like, are swept by the cleaning component 1 and delivered to the first-level wind duct 4, the cleaned objects are gradually moved away from the cleaning component 1 and closer to the storage component 2 (close to the power component 3 gradually at the same time). Even though the sweeping force applied to the cleaned objects by the cleaning component 1 decreases gradually, the suction force applied to the cleaned objects by the power component 3 increases gradually, such that the cleaned objects are ensured to be sucked and delivered to the cleaned object storage component 2.

Figure 12:
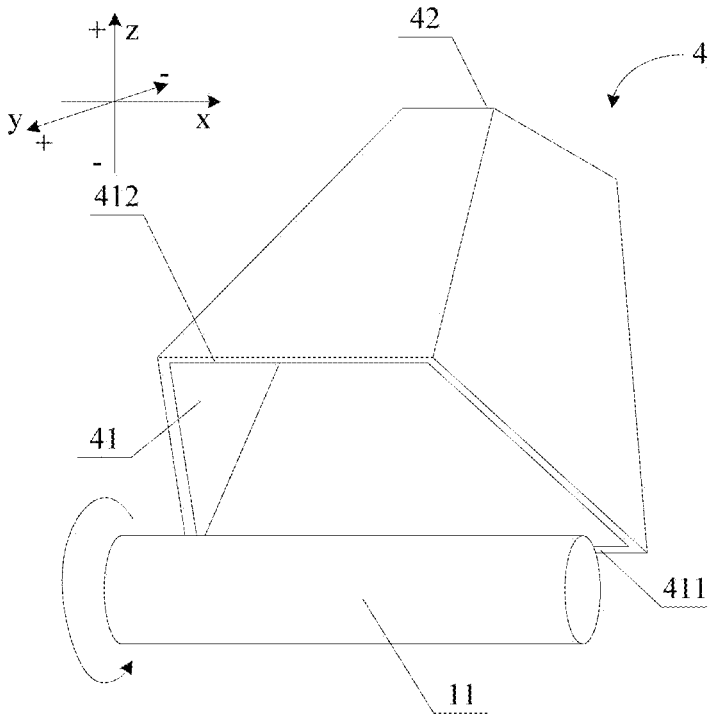
FIG. 12 is a schematic diagram illustrating a three-dimensional view of a first-level wind duct engaged with a main brush, according to an exemplary embodiment.

Furthermore, as shown in FIG. 11, when the cleaning component 1 is a main brush assembly, the first-level wind duct 4 includes an air inlet 41 facing the main brush 11 of the main brush assembly. A width of a horizontal cross section of the air inlet 41 in a direction perpendicular to the moving direction (i.e., the width of the horizontal cross section along the x axis) decreases along the moving direction. For ease of understanding, the matching relationship between the first-level wind duct 4 and the main brush 11 will be described in connection with FIG. 12. FIG. 12 is a schematic diagram illustrating a three-dimensional view of the first-level wind duct 4 engaged with the main brush 11, according to an exemplary embodiment. As shown in FIG. 12, the air inlet 41 of the first-level wind duct 4 is close to the main brush 11 and has a larger cross-sectional area, while an air outlet 42 is remote from the main brush 11 and has a smaller cross-sectional area. Due to the above-described decreasing width of the horizontal cross section of the air inlet 41 along the moving direction, the cross section of the air inlet 41 may be a trapezoid. The air inlet 41 includes a first side 411 and a second side 412. The first side 411 is the longer base of trapezoid and the second side 412 is the shorter base of the trapezoid. In the disclosed embodiments, the horizontal cross section of the air inlet 41 may also have other shapes, as long as the air inlet 41 has the above-described "decreasing width." For example, the two legs (i.e., the two sides that are not parallel) of the trapezoid may be replaced by arcs. The present disclosure does not limit the shape of the air inlet 41.

With the above-described "decreasing width," the vacuum net pressure values increases as the width decreases. This way, when the cleaned objects, such as dust, garbage, and the like, are swept and delivered by the main brush 11 to the air inlet 41, wind generated by the power component 3 can provide enough suction force to suck as many cleaned objects as possible at the air inlet 41 into the cleaned object storage component 2. As such, the cleaning efficiency of the autonomous cleaning device is improved.

As shown in FIG. 11, the air inlet 41 of the first-level wind duct 4 is connected with the main brush bin 12 of the main brush assembly (i.e., the cleaning component 1) and faces the main brush 11 of the main brush assembly via an opening on the main brush bin 12. Moreover, the first-level wind duct 4 has two side walls along the rolling direction of the main brush 11: a first side wall 43 located at a rear end of the main brush 11 in the moving direction, and a second side wall 44 located at a front end of the main brush 11 in the moving direction. The details about the structural arrangement of the first side wall 43 and the second side wall 44 are described as follows.

1) The First Side Wall 43

Figure 13:
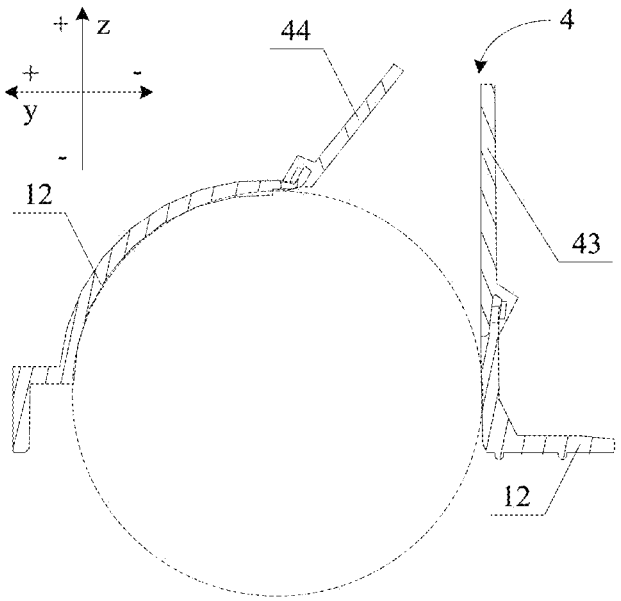
FIG. 13 is a schematic diagram illustrating a cross-sectional view of a first-level wind duct engaged with a main brush bin, according to an exemplary embodiment.

In some embodiments, the first side wall 43 is arranged along a tangential direction of a circular cross section of the main brush bin 12. FIG. 13 is a schematic diagram illustrating a cross-sectional view of the first-level wind duct 4 engaged with the main brush bin 12, according to an exemplary embodiment. As shown in FIG. 13, the main brush bin 12 includes a left arc structure and a right L-shaped structure. The arc of the left art structure corresponds to the circular dotted area shown in FIG. 13. The circular dotted area corresponds to the circular cross section of the main brush bin 12. Correspondingly, the first side wall 43 of the first-level wind duct 4 is arranged along the tangential direction of the circular dotted area, For example, based on the relative position relationship shown in FIG. 13, the first side wall 43 is arranged in the vertical direction, since the first-level wind duct 4 is disposed obliquely above the main brush assembly and behind the main brush 11 in the moving direction.

In the disclosed embodiments, after being swept by the main brush 11 from the ground, the cleaned objects first move along the gap between the main brush 11 and the main brush bin 12, and then move from the main brush assembly to the first-level wind duct 4. By disposing the first side wall 43 along the tangential direction, the moving path of the cleaned objects and the flow of the wind will not be blocked by the first side wall 43, such that the cleaned objects can successfully enter the cleaned object storage component 2 through the first-level wind duct 4.

2) The Second Side Wall 44

Referring to FIGS. 11 and 13, in one embodiment, the cleaning component 1 is a main brush assembly. The first-level wind duct 4 is located behind the main brush 11 in the moving direction, and the first-level wind duct 4 has an air inlet 41 that faces the main brush 11. The main brush 11 is located in front of the air inlet 41 in the moving direction (for example, in the left side of FIG. 11) and obliquely below the entry. The first-level wind duct 4 also has an air outlet 42 that is connected to an air inlet 21 of the cleaned object storage component 2. The cleaned object storage component 2 is located behind the air outlet 42 in the moving direction (for example, in the right side of FIG. 11) and obliquely above the air outlet 42. Moreover, the cleaned object storage component 2 has an air outlet 22 that is not located at a top side of the cleaned object storage component 2. For example, referring to FIG. 11, the air outlet 22 is not located at the top side 23. Instead, the air outlet 22 is located at the right side of the cleaned object storage component 2.

Referring to FIG. 13, the second side wall 44 of the first-level wind duct 4 is tilted backward to a horizontal plane. In some embodiments, the second side wall 44 is tilted close to the horizontal plane as much as possible. That is, the angle formed between the second side wall 44 and the z axis in the vertical direction is made as large as possible. In practice, due to the limitation of the inner space of the autonomous cleaning device, the main brush assembly, the first-level wind duct 4, and the cleaned object storage component 2 have a compact arrangement. One way to save space would be to arrange the first-level wind duct 4 along the z axis. However, this arrangement will cause great loss of the wind volume, and thus great reduction of the suction efficiency. To avoid this problem, in the disclosed embodiments, when the inner space of the autonomous cleaning device is limited, by increasing the angle between the first side wall 43 and the z axis, the wind is first directed upward obliquely to an inner top 23 of the cleaned object storage component 2, then reflected at a large angle by the inner top 23 to a mesh filter (not shown) at the air outlet 22, and finally outputted from the air outlet 22 in an approximately horizontal direction. This wind path design with a large reflection angle causes little loss of wind volume. In contrast, to save space, the wind path used in the prior art first directs the wind vertically upward. In this configuration, because the wind is reflected downward when encountering a turning of the wind path, the wind volume will be lost significantly at the turning of the wind path. Moreover, in the case where the wind is directed vertically up, when the autonomous cleaning device shuts down, the cleaned objects in the first-level wind duct 4 will fall back on the ground and cause secondary pollution to the ground. As such, the wind path in the present disclosure improves the suction and cleaning efficiency.

Referring back to FIG. 11, the air inlet 41 of the first-level wind duct 4 faces the main brush 11 located at the lower left side of the air inlet 41. The air outlet 42 is connected to the air inlet 21 of the cleaned object storage component 2. This way, when the first-level wind duct 4 directs the wind into the cleaned object storage component 2, the cleaned objects carried by the wind are blown to the inner top 23 of the cleaned object storage component 2. Because the air outlet 22 of the cleaned object storage component 2 is not at the inner top 23, the wind needs to have a large incident angle at the inner top 23, such that the wind can be reflected into the second-level wind duct 5 via the air outlet 22. The large cross-sectional area in the cleaned object storage component 2 reduces the wind speed at the cleaned object storage component 2, so the cleaned objects fall down from the inner top 23 and stay in the cleaned object storage component 2. Furthermore, due to the reduction of the wind speed and the change of the wind direction, even though the wind itself can flow to the air outlet 22 and enter the second-level wind duct 5, the cleaned objects are not blown to the air outlet 22. As such, when the cleaned objects storage component 2 is a dust box assembly and a mesh filter 24 is installed at the air outlet 22, the cleaned objects will not be blown to the mesh filter 24 directly or block the the mesh filter 24, which contributes to the utilization of the wind volume.

Figure 14:
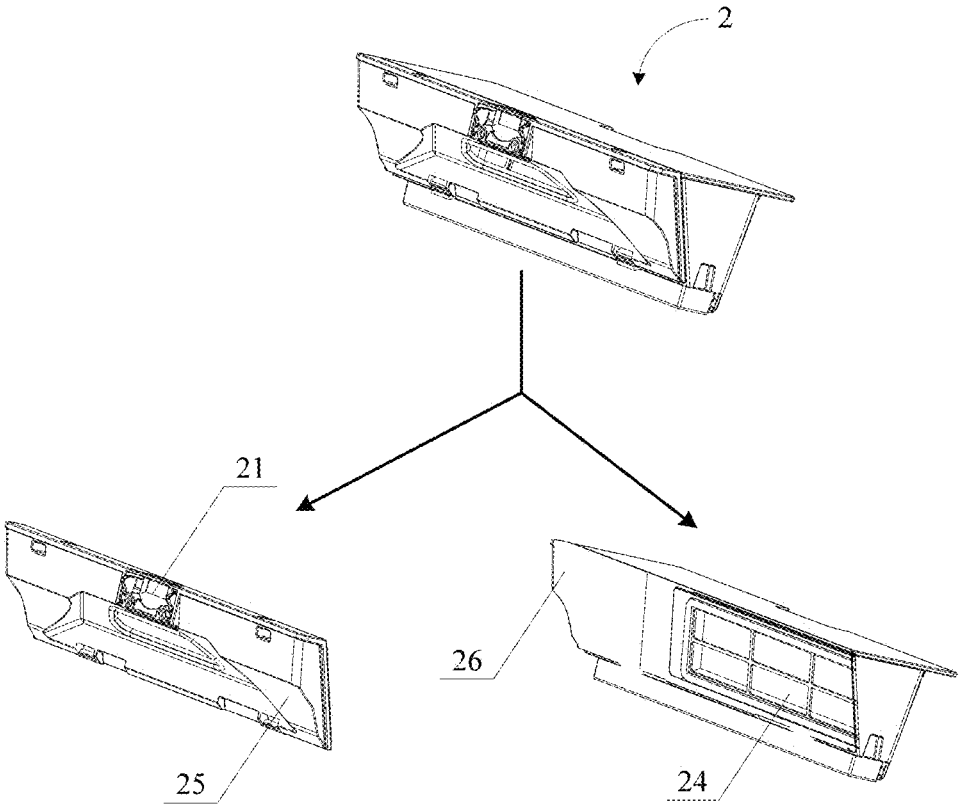
FIG. 14 is a schematic diagram illustrating a three-dimensional view of a cleaned object storage component, according to an exemplary embodiment.

FIG. 14 is a schematic diagram illustrating a three-dimensional view of the cleaned object storage component 2, according to an exemplary embodiment. Referring to FIG. 14, the cleaned object storage component 2 is a dust box assembly. The dust box assembly has a removable side wall 25. An air inlet 21 is located on the removable side wall 25. When the side wall 25 is removed from the dust box assembly, a dumping opening 26 is formed on the dust box assembly for dumping the cleaned objects stored in the dust box assembly. Because the air inlet 21 is located on the side wall 25, the size of the side wall 25 is larger than the air inlet 21. Thus, when the side wall 25 is removed from the dust box assembly, the resulted dumping opening 26 is larger than the air inlet 21, such that the cleaned objects can be conveniently dumped from the dust box assembly.

3. Smooth Guidance of the Second-Level Wind Duct 5

Figure 15:
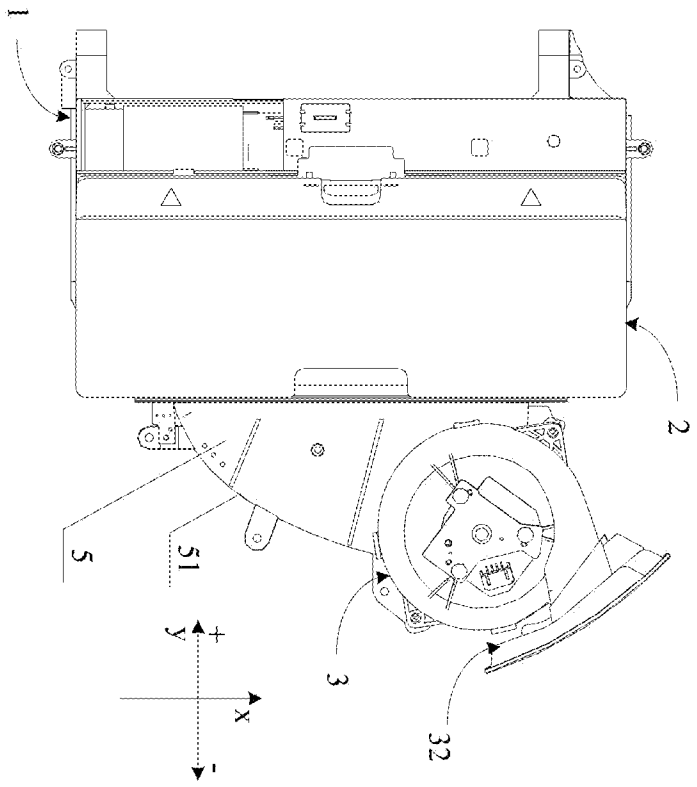
FIG. 15 is a schematic diagram illustrating a top view of the wind path structure shown in FIG. 11, according to an exemplary embodiment.

FIG. 15 is a schematic diagram illustrating a top view of the wind path structure shown in FIG. 11, according to an exemplary embodiment. As shown in FIG. 15, the cleaning component 1, the cleaned object storage component 2, and the power component 3 are arranged sequentially along the moving direction of the autonomous cleaning device (i.e., the $_{+}$y axis), and the cleaned object storage component 2 is deviated from the power component 3 in the x-axis direction (i.e., the left-right direction of the autonomous cleaning device). With this configuration, when the wind blows from the cleaned object storage component 2 to the power component 3, the wind has motions along the y-axis direction (i.e., the left to right direction in FIG. 6) and the x-axis direction (i.e., the bottom up direction in FIG. 6). That is, the wind makes turns in the flowing process. Of course, in some embodiments, the cleaned object storage component 2 and the power component 3 have no deviation in the x-axis direction, which is not limited by the present disclosure.

As shown in FIG. 15, the second-level wind duct 5 is shaped as a bell mouth. Specifically, the second-level wind duct 5 has a relatively large cross-sectional area at the side close to the cleaned object storage component 2, and has a relatively small cross-sectional area at the side close to the power component 3, such that the wind is gathered to an air inlet of the power component 3. When the wind blows to the second-level wind duct 5 from the cleaned object storage component 2, due to the reduction of the cross-sectional area, the wind directly blows to an inner wall of the second-level wind duct 5 located at a windward side 51 of the second-level wind duct 5. In the present disclosure, the inner wall at the windward side 51 has an arc shape. With this design, on one hand, the wind outputted from the cleaned object storage component 2 can be directed in the x-axis direction, such that the wind is blown to the air inlet of the power component 3. On the other hand, the structure of the second-level wind duct 5 assists the flow of the wind, so as to avoid blocking the wind or generating turbulence. Thus, the cleanliness and cleaning efficiency of the autonomous cleaning device are improved.

As can be seen in FIGS. 11 and 15, the cleaned objects cleaned by the cleaning component 1 are delivered to the cleaned object storage component 2 by the wind generated by the power component through the first-level wind duct. Thus, by improving the wind utilization and reducing the airflow loss, the delivery capacity of wind is increased, and the cleanliness and cleaning efficiency of the autonomous cleaning device are improved.

4. Tilting Arrangement of the Power Component 3

Figure 16:
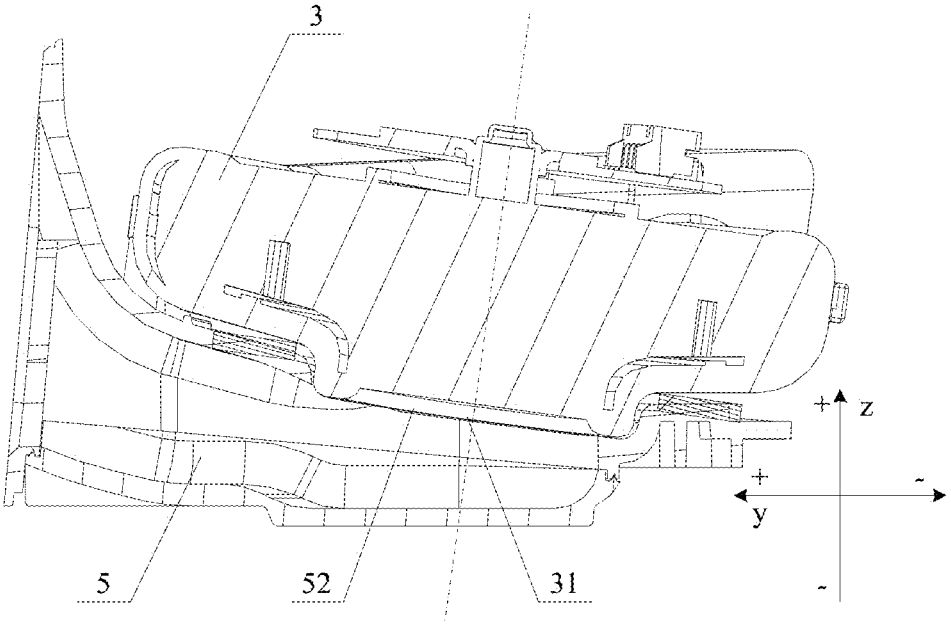
FIG. 16 is a schematic diagram illustrating a cross-sectional view of a second-level wind duct and a power component, according to an exemplary embodiment.

FIG. 16 is a schematic diagram illustrating a cross-sectional view of the second-level wind duct 5 and the power component 3, according to an exemplary embodiment. As shown in FIG. 16, the second-level wind duct 5 has an air outlet 52 located at a remote end from the cleaned object storage component 2 (not shown in FIG. 16). The air outlet 52 is coupled with the air inlet 31 of the power component 3. The air outlet 52 is in a plane intersecting with the horizontal plane. That is, the air outlet 52 is tilted toward a horizontal plane. In one embodiment, the power component 3 is an axial flow fan and the air inlet 31 is aligned along the direction of the rotation axis of the axial flow fan (the direction of the rotation axis is shown as the dotted line shown in FIG. 16). Thus, the axial flow fan is tilted to the horizontal plane, such that the air outlet 52 coupled with the air inlet 31 is also tilted to the horizontal plane.

When the air outlet 52 and the air inlet 31 are in a vertical plane, the wind mainly flows in a horizontal plane when flowing in the second-level wind duct 5 and when flowing from the second-level wind duct 5 to the power component 3, such that when the wind flow from the second-level wind duct 5 to the axial flow fan, the wind is mainly parallel to the rotation axis direction. In this configuration, the axial flow fan achieves the maximum conversion efficiency (i.e., the efficiency of converting the electrical energy to the wind energy). In contrast, when the air outlet 52 and the air inlet 31 are in a horizontal plane, the wind flows in the second-level wind duct 5 mainly in the horizontal plane, but changes to the vertical direction when flowing into the power component 3 from the second-level wind duct 5, which leads to a minimum conversion efficiency of the axial flow fan.

However, due to the limitation of the inner space of the autonomous cleaning device, it is not practical to align the air outlet 52 and the air inlet 31 in the vertical plane. Thus, in the technical solution of the present disclosure, by increasing the angle between the axial flow fan used as the power component 3 and the horizontal plane as much as possible, the inner space of the autonomous cleaning device can be used properly while the conversion efficiency of the axial flow fan can be optimized.

Figure 17:
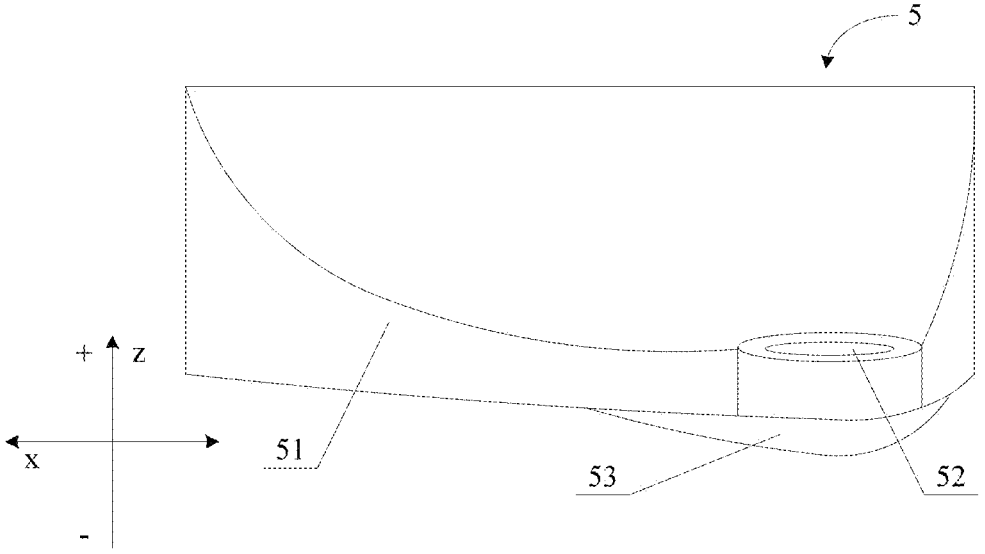
FIG. 17 is a schematic diagram illustrating a side view of the wind path structure shown in FIG. 11, according to an exemplary embodiment.

In the technical solution of the present disclosure, the second-level wind duct 5 has a side wall facing the air outlet 52. The side wall bulges outward to increase the capacity of the inner chamber of the second-level wind duct 5 at the air outlet 52, such that the energy loss of the wind generated by the power component 3 at the air outlet 52 is lower than a preset level. FIG. 17 is a schematic diagram illustrating a side view of the wind path structure shown in FIG. 11, according to an exemplary embodiment. As shown in FIG. 17, when the air outlet 52 is located at a top side of the second-level wind duct 5, the side wall facing the air outlet 52 is at a bottom side, which is bulged down to form a bulge structure 53, so as to increase the inner space of a chamber at the air outlet 52. This way, in a case where the wind changes direction at the air outlet 52 (i.e., the air outlet 52 is not in a vertical plane) and blows to the power component 3, a larger buffer space is provided to reduce the energy loss of the wind at the air outlet 52.

5. Fully Sealing of the Wind Path Structure

As can be seen from the above description, the vacuum degree and the wind volume also contribute to a high suction efficiency. As such, in some embodiments, all the joints between the components of the wind path structure are sealed. For example, gaps at the joints are filled with soft rubber and the like to avoid air leakage, so as to reduce the loss of vacuum degree. As shown in FIG. 15, a soft rubber element 32 is used at the air outlet of the fan to ensure all the wind is exported from the autonomous cleaning device. The soft rubber element 32 is not only used to avoid air leakage (i.e., avoid reducing the vacuum degree), but also used to avoid dust getting into the electric motor of the autonomous cleaning device, so as to extend the service life of the autonomous cleaning device.

Other embodiments of the invention will be apparent to those skilled in the art from consideration of the specification and practice of the present disclosure. This application is intended to cover any variations, uses, or adaptations of the present disclosure following the general principles thereof and including such departures from the present disclosure as come within known or customary practice in the art. It is intended that the specification and examples be considered as exemplary only, with a true scope and spirit of the invention being indicated by the following claims.

It will be appreciated that the present disclosure is not limited to the exact construction that has been described above and illustrated in the accompanying drawings, and that various modifications and changes can be made without departing from the scope thereof. It is intended that the scope of the invention only be limited by the appended claims.

What is claimed is:

1. A wind path structure for use in an autonomous cleaning device, comprising:

a cleaning component for cleaning cleaned objects, a cleaned object storage container for storing the cleaned objects, and a power component for generating a wind, the cleaning component, the cleaned object storage container, and the power component being arranged sequentially in a moving direction of the autonomous cleaning device;

a first-level wind duct located between the cleaning component and the cleaned object storage container, wherein the first-level wind duct is coupled with the power component such that the cleaned objects are delivered to the cleaned object storage container by the wind generated by the power component; and a second-level wind duct located between the cleaned object storage container and the power component, wherein the second-level wind duct has a bell-mouth shape and includes an inner wall, the inner wall including an arc-shaped segment facing toward the wind coming from the cleaned object storage container to direct the wind to an air inlet of the power component.

2. The wind path structure of claim 1, wherein the second-level wind duct includes an air outlet located at an end of the second-level wind duct remote from the cleaned object storage container, the air outlet of second-level wind duct being in a plane intersecting with a horizontal plane.

3. The wind path structure of claim 2, wherein:

the air outlet of the second-level wind duct is coupled with the air inlet of the power component;

the power component includes an axial flow fan; and the air inlet of the power component and a rotation axis of the axial flow fan are aligned in a same direction.

4. The wind path structure of claim 1, wherein:

the first-level wind duct has a bell-mouth shape; and an area of a cross section of the first-level wind duct is inversely correlated with a distance from the cross section to the cleaning component.

5. The wind path structure of claim 1, wherein:

the cleaning component is a main brush assembly including a main brush; and the first-level wind duct includes an air inlet facing the main brush assembly, a width of a horizontal cross section of the air inlet decreasing along the moving direction, the width being in a direction perpendicular to the moving direction.

6. The wind path structure of claim 1, wherein:

the cleaning component is a main brush assembly including a main brush bin and a main brush; and the first-level wind duct includes:

an air inlet coupled with the main brush bin and facing the main brush via an opening on the main brush bin; and a side wall at a rear end of the main brush bin in the moving direction, the side wall being coupled with the main brush bin along a tangential direction of a circular cross section of the main brush bin.

7. The wind path structure of claim 6, wherein the tangential direction of the circular cross section of the main brush bin is along a vertical direction, and the first-level wind duct is located obliquely above the main brush assembly and behind the main brush in the moving direction.

8. The wind path structure of claim 1, wherein:

the cleaning component is a main brush assembly including a main brush; and the first-level wind duct is located at a rear end of the main brush in the moving direction, the first-level wind duct including:

an air inlet facing the main brush and located obliquely above the main brush;

an air outlet coupled with an air inlet of the cleaned object storage container, the cleaned object storage container being located behind the air outlet of the first-level wind duct in the moving direction and obliquely above the air outlet of the first-level wind duct, wherein the air outlet of the cleaned object storage container is not located at a top side of the cleaned object storage container; and a side wall located at a front end of the first-level wind duct in the moving direction and tilted toward a horizontal plane, such that the wind generated by the power component is directed to the top side of the cleaned object storage container and reflected by the top side to the air outlet of the cleaned object storage container, wherein the wind generated by the power component delivers the cleaned objects to the top side of the cleaned object storage container such that the cleaned objects fall in the cleaned object storage container.

9. The wind path structure of claim 1, wherein the second-level wind duct includes:

an air outlet coupled with the power component; and a side wall facing the air outlet of the second-level wind duct, the side wall bulging outward to expand an inner space of the second-level wind duct at the air outlet, to reduce energy loss of the wind generated by the power component at the air outlet of the second-level wind duct below a preset level.

10. The wind path structure of claim 1, wherein the cleaned object storage component is a dust box assembly including:

a removable side wall, wherein when the side wall is removed from the dust box assembly, a dumping opening is formed on the dust box assembly for dumping the cleaned objects stored in the dust box assembly; and an air inlet located on the removable side wall, the air inlet being coupled with the first-level wind duct.

11. The wind path structure of claim 1, wherein the cleaned object storage component is a main brush assembly including a rubber brush element and at least one hair brush element, wherein:

the rubber brush element forms, on a cylindrical surface of the main brush assembly, a first deflection angle with a rotation axis of the main brush assembly, such that a wind intensity maintained by the rubber brush element achieves or exceeds a preset intensity; and each hair brush element forms, on the cylindrical surface of the main brush assembly, a second deflection angle with the rotation axis of the main brush assembly, such that when hair tufts of the hair brush element are arranged sequentially along the rotation axis of the main brush assembly, an angle covered by the hair brush element along circumference of the cylindrical surface of the main brush assembly achieves or exceeds a preset angle, wherein the second deflection angle is larger than the first deflection angle.

12. The wind path structure of claim 11, wherein the rubber brush element is distributed in a substantially straight line along the rotation axis of the main brush assembly and on the cylindrical surface of the main brush assembly.

13. The wind path structure of claim 12, wherein a central part of the rubber brush element is bent towards the moving direction of the autonomous cleaning device, such that the wind generated by the power component gathers the cleaned objects at the central part of the rubber brush element.

14. The wind path structure of claim 11, wherein the at least one hair brush element fully covers the circumference of the cylindrical surface of the main brush assembly.

15. The wind path structure of claim 1, wherein the cleaning component is a main brush assembly including an anti-winding guard and a soft rubber scraper bar behind the anti-winding guard in the moving direction, the anti-winding guard further including an obstacle-crossing accessory at a rear end of the anti-winding guard in the moving direction, the obstacle-crossing accessory abutting a top surface of the soft rubber scraper bar.

16. The wind path structure of claim 15, wherein the obstacle-crossing accessory is a downward protrusion formed at the rear end of the anti-winding guard.

17. The wind path structure of claim 16, wherein the protrusion includes a first edge at a front end of the bulge in the moving direction, the first edge being configured to assist the autonomous cleaning device to cross an obstacle in an obstacle crossing process.

18. The wind path structure of claim 17, wherein the protrusion includes a second edge at a rear end of the protrusion in the moving direction, the second edge abutting the top surface of the soft rubber scraper bar, and the second edge forming an acute angle with the first edge.

19. The wind path structure of claim 1, wherein joints between the cleaning component, the first-level wind duct, the cleaned object storage container, the second-level wind duct, and the power component are sealed.

20. An autonomous cleaning device, comprising a wind path structure including:

a cleaning component for cleaning cleaned objects, a cleaned object storage container for storing the cleaned objects, and a power component for generating a wind, the cleaning component, the cleaned object storage container, and the power component being arranged sequentially in a moving direction of the autonomous cleaning device;

a first-level wind duct located between the cleaning component and the cleaned object storage container, wherein the first-level wind duct is coupled with the power component such that the cleaned objects are delivered to the cleaned object storage container by the wind generated by the power component; and a second-level wind duct located between the cleaned object storage container and the power component, wherein the second-level wind duct has a bell-mouth shape and includes an inner wall, the inner wall including an arc-shaped segment facing toward the wind coming from the cleaned object storage container to direct the wind to an air inlet of the power component.

* * * * *